United States Patent [19]

Van Roosmalen et al.

[11] 4,432,738

[45] Feb. 21, 1984

[54] CAMERA TUBE AND METHOD OF MANUFACTURING SAME

[75] Inventors: Johannes H. T. Van Roosmalen; Franciscus C. M. De Haas, both of Eindhoven, Netherlands

[73] Assignee: U.S. Philips Corporation, New York, N.Y.

[21] Appl. No.: 260,665

[22] Filed: May 4, 1981

Related U.S. Application Data

[62] Division of Ser. No. 56,481, Jul. 11, 1979, Pat. No. 4,309,638.

[30] Foreign Application Priority Data

Jul. 20, 1978 [NL] Netherlands ..... 7807757

[51] Int. Cl.[3] ..... H01J 9/18

[52] U.S. Cl. ..... 445/34; 445/36; 445/4

[58] Field of Search ..... 29/25.13, 25.14, 25.15, 29/25.16; 445/34, 36, 4

[56] References Cited

U.S. PATENT DOCUMENTS

| | | | |
|---|---|---|---|
| 2,146,365 | 2/1939 | Batchelor | 313/447 |
| 2,411,184 | 11/1946 | Beggs | 29/25.16 |
| 2,945,295 | 7/1960 | Feaster | 29/25.14 |
| 3,128,407 | 4/1964 | Mattson | 313/451 |
| 3,500,520 | 3/1970 | Oess | 29/25.16 |
| 3,885,191 | 5/1975 | Kerstetter | 313/451 |
| 3,928,784 | 12/1975 | Weijland | 313/389 |
| 3,984,261 | 7/1975 | Corson | 313/449 |
| 4,112,327 | 9/1978 | Eisele | 313/446 |

FOREIGN PATENT DOCUMENTS

| | | | |
|---|---|---|---|
| 50983 | 7/1938 | France | 313/446 |

OTHER PUBLICATIONS

Funk Technik, No. 1-1978, pp. 1-6.

*Primary Examiner*—Kenneth J. Ramsey
*Attorney, Agent, or Firm*—Marc D. Schechter

[57] ABSTRACT

An electron gun for a camera tube includes an anode and a cathode. The cathode is assembled in a cathode support which can very readily be adjusted relative to the anode in the non-connected condition. In particular, the cathode support and the anode are movable radially with respect to each other and with respect to an axis. An emissive cathode surface and a part of the anode extending perpendicular to the axis remain accurately parallel to each other during the radial movement. As a result of this it is possible to cause the central path of the generated electron beam and the gun axis to coincide so that extra correction coils for aligning the electron beam may be omitted.

3 Claims, 8 Drawing Figures

CAMERA TUBE AND METHOD OF MANUFACTURING SAME

This is a division of application Ser. No. 056,481, filed July 11, 1979, now U.S. Pat. No. 4,309,638.

BACKGROUND OF THE INVENTION

The invention relates to a camera tube comprising an electron gun in one end of a tubular evacuated envelope. The electron gun consists of a cathode, which is placed on an axis and has an emissive surface extending substantially perpendicular to the axis, and an electrode having a central aperature in a part of the electrode which is perpendicular to the axis. The central aperture is partly closed by means of an apertured plate. The cathode is connected to a metal cathode support so as to be electrically insulated from the support and substantially concentric to the support. The support comprises a part which extends perpendicular to the axis and is placed against the part of the electrode extending perpendicular to the axis. The parts of the support and the electrode which extend perpendicular to the axis are connected together.

The invention also relates to a method of manufacturing such a camera tube.

Such camera tubes have a wide field of application, for example, television cameras and infrared cameras.

Such an electron gun is known from Funk Technik, No. 1-1978, pages 1-6, in which a cathode is connected to the cathode support by means of a plug of insulating material. The cathode support is secured to a first grid (wehnelt electrode). The first grid has a central circular aperture in which the cathode support is centered by means of a coaxial groove. Such a construction is much too inaccurate for use in a television camera tube having an electron gun of the type described above. The cathode is frequently assembled in a noncentral and inclined position in the cathode support. Position corrections are no longer possible after the cathode is mounted in the cathode support.

A similar camera tube and in particular a similar electron gun is disclosed in U.S. Pat. No. 3,894,261. However, nothing is stated about the construction, the positioning and the connection of the cathode, cathode support and anode.

In addition to the electron gun, such tubes include a focusing lens to focus the generated electron beam on a photoconductive layer provided on a signal plate. A potential distribution is produced on the photoconductive layer by projecting an optical image on it. By scanning the photoconductive layer with the electron beam, the signal plate provides signals which correspond to the optical image. The formation of an electron beam and the scanning with the electron beam provides many problems, particularly in the case of small camera tubes. It has been found, for example, that if the central path of the electron beam passing through the aperture in the anode plate encloses an angle of 1° with the axis of the gun, the intensity of the electron beam impinging on the photoconductive layer (the beam current) is already reduced by 25%. Since it is substantially impossible, in assembling the abovedescribed construction known for Funk Techik, No. 1, 1978, to cause the gun axis and the central path to coincide substantially, it is not attactive to use such a gun in camera tubes because the noncoincidence has to be corrected by means of extra correction coils.

SUMMARY OF THE INVENTION

It is therefore an object of the invention to provide a construction and a method in which it is possible in a simple manner to cause the axis of the electron gun and the central path of the electron beam to coincide so that correction means are not necessary.

A camera tube of the kind described above is characterized, according to the invention, in that the electron gun includes an anode, and this anode and the cathode support prior to connection to each other are movable radially with respect to each other. The emissive cathode surface and the part of the anode extending perpendicular to the axis remain accurately parallel to each other for each relative radial position of the anode and the cathode support.

In electron guns which are not of the abovedescribed type, the radial position of the emissive surface relative to the anode is not so important as it is in guns of this type. In the construction of electron guns according to the invention it is possible to place the center of the emissive surface accurately opposite the aperture in the anode plate so that the axes of the gun and the electron beam coincide. A result thereof is, in addition, that the emissive surface of the cathode may be considerably smaller than has been usual so far, so that the anode dissipation decreases considerably.

The cathode support preferably has an inwardly extending flange since in that case more space is available for the assembly of the cathode in the cathode support. The centering of the gun in the envelope is obtained in a simple manner if the anode has a cylindrical surface portion, parallel to the axis, which surrounds the cathode support and which engages the inner wall of the tube envelope. The anode-cathode distance is fully determined by the shape of the anode if the surface of the cathode support, situated on the anode side and extending perpendicular to the axis, and the emissive surface are situated in one plane.

The surface of the cathode support secured against the anode and the emissive cathode surface can be situated in one plane simply if, according to a further preferred embodiment of the invention, the cathode is secured in the cathode support by means of a disc of electrically insulating material situated substantially coaxially in the support. The curved surface of the disc is convex and the disc is fixed in the cathode support by means of three depressions in the cathode support.

A preferred method of manufacturing such a camera tube according to the invention is characterized in that the emissive surface of the cathode and the surface of the cathode support situated on the anode side are placed in parallel planes or in one plane, the emissive surface situated opposite an opening in the surface of the cathode support, and then the cathode and support are secured together. Next, the cathode support is placed against the part of the anode extending perpendicular to the axis. The center of the emissive surface is then placed opposite the center of the central aperture in the anode, by radially moving the support relative to the anode. The cathode support is then secured to the anode, after which the anode plate is provided in the anode. The center of the aperture in the anode plate is placed opposite the center of the emissive surface and then the anode plate is secured to the anode.

The emissive surface and the surface of the cathode support situated on the anode side can simply be provided in one plane by pressing the cathode and the surface of the cathode support against a transparent, for example, glass plate. The use of a transparent plate makes it possible to visually check that the emissive surface is situated indeed entirely in one plane. Moreover, in the case of a molded oxide cathode the material of the emissive layer is slightly pressed, which has a favorable influence on the surface structure of the layer. By using a glass plate, no materials poisoning the cathode land in the cathode during pressing.

BRIEF DESCRIPTION OF THE DRAWING

The invention will now be described in greater detail with reference to a drawing.

DESCRIPTION OF THE PREFERRED EMBODIMENTS

Figure 1:
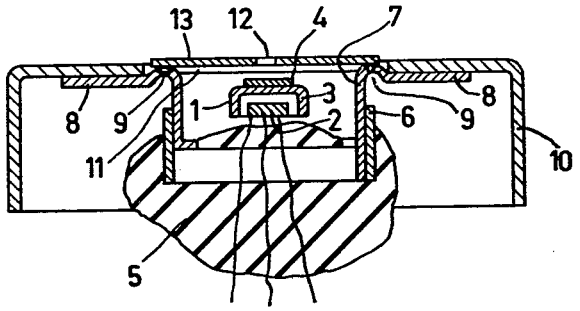
FIG.1 PRIOR ART
FIG. 1 is a sectional view of a part of a prior art electron gun.

FIG. 1 is a sectional view of a part of a prior art electron gun. The gun comprises a cathode 1 consisting of a heating element 2 in a cathode body 3 on which an emissive layer 4 is provided. This cathode is secured to the cathode support 7 by means of a plug of insulating material 5 and a bushing 6. The cathode support 7 is cylindrical and has a flange 8 extending perpendicularly away from an end of the cylinder and a centering groove 9. As a result of the centering groove the cathode support and the anode are fixed relative to each other in the radial direction. The flange 8 is welded against the first grid 10 which has a central aperture 11. The aperture 11 is sealed by means of a plate 13 having an aperture 12. The disadvantage of this construction is that the assembly of the cathode 1 in the cathode support 7 is inaccurate. As a result of this the emissive surface 4 is often inclined and not centered relative to aperture 12 in the plate 13. In addition, the cathode is not centered around the axis of electrode 10. Such a construction is not suitable for an electron gun in which the gun axis and the central path of the generated electron beam have to coincide very accurately.

Figure 2:
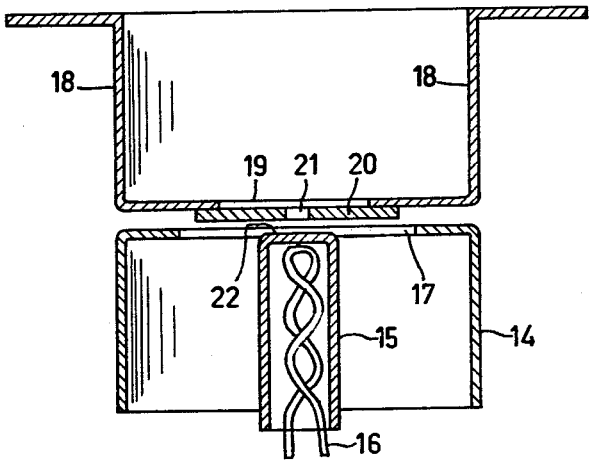
FIG.2 PRIOR ART
FIG. 2 is a sectional view of a prior art electron gun.

FIG. 2 is a sectional view of a prior art electron gun. A cathode 15 having a heating member 16 is situated in a cathode support 14. The cathode support has a central aperture 17. An anode 18 having a circular central aperture 19 is provided opposite to the cathode 15. The aperture 19 is sealed by means of an anode plate 20 having a bore 21. The difficulty in such electron guns is to position the center of the emissive surface 22 opposite to the center of the aperture 21 in the anode plate 20, after which the various parts are secured together.

Figure 3:
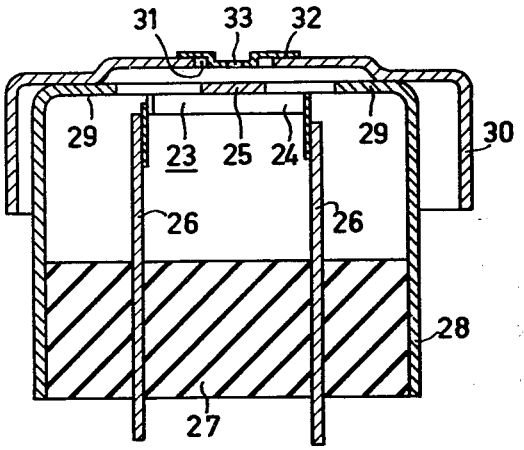
FIG. 3 is a sectional view of an embodiment of an electron gun for a camera tube embodying the invention.

FIG. 3 is a sectional view of an embodiment of an electron gun according to the invention for a camera tube. The cathode 23 includes a cathode body 24 in which a heating member (not visible) is provided. The cathode body 24 has an emissive layer 25 and is secured in a disc of electrically insulating material 27 (for example glass or ceramic) by means of rods 26. The disc 27 is secured in the cylindrical cathode support 28 which has a radially inwardly extending flange 29. Flange 29 is secured against the anode 30. Anode 30 has a central circular aperture 31 which is closed partly by a plate 32 which has an aperture 33 and is secured to the anode. The advantage of such a construction is that the cathode support 28 with the cathode mounted therein can be moved radially with respect to the anode 30 prior to welding it in the anode in such manner that the center of the emissive layer 25, the center of the central aperture 31, and the center of the aperture 33 in the plate 32 become located accurately on one axis, namely the gun axis.

Figure 4:
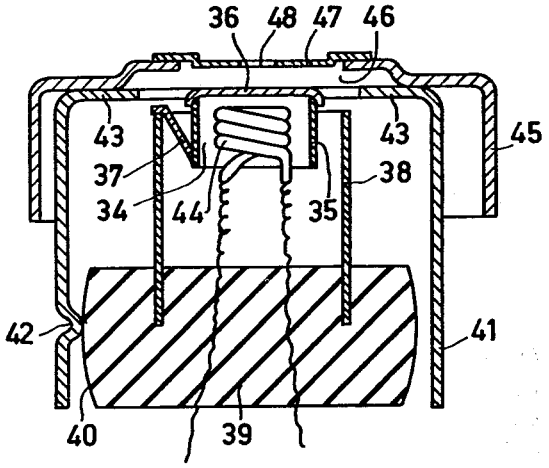
FIG. 4 is a sectional view of a second embodiment of an electron gun for a camera tube embodying the invention.

FIG. 4 is a sectional view of a second embodiment of an electron gun according to the invention for a camera tube. In this case the cathode 34 includes a cylindrical cathode body 35 which is closed at one end. The end face of cathode body 35 has an emissive layer 36. A heating member 44 is present in cathode body 35. The cathode body 35 is inside and connected to a metal bushing 38 by means of a few metal ribbons 37. The bushing 38 is secured to a disc 39 of electrically insulating material. This disc 39 has a convex surface 40 so that it can tilt within the cathode support 41. The disc is fixed in the cathode support 41 by means of three depressions 42. As a result of the tilting, flange 43 and the surface of the emissive layer 36 can be moved very simply and accurately in one plane.

The cathode support 41 is secured to the anode 45 in such manner that the center of the emissive layer 36 and the center of the central circular aperture 46 in the anode are situated on the gun axis. The anode 45 has an anode plate 47 having an aperture 48 which is also situated on the gun axis.

A preferred method of manufacturing an electron gun according to the invention will be described in greater detail with reference to FIGS. 5, 6 and 7.

Figure 5:
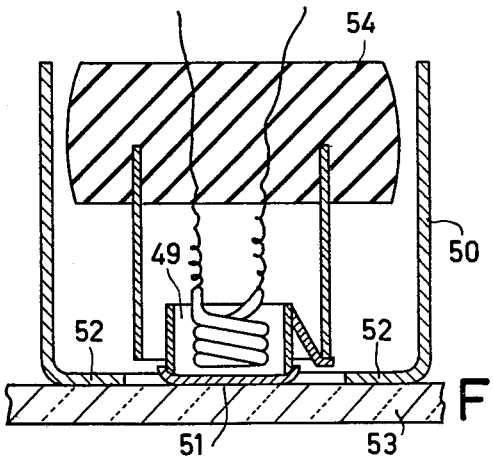
FIGS. 5, 6 and 7 illustrate a method of manufacturing an electron gun according to the invention.

FIG. 5 shows the assembly of a cathode 49 in a cathode support 50. The emissive layer 51 of the cathode 49 and the flange 52 of the cathode support 50 are pressed against a transparent plate 53. As a result of this the emissive layer 51 and the flange 52 become located in one flat plane. Whether the emissive layer 51 indeed engages the plate 53 can readily be observed through the transparent (glass) plate. It is also possible to use a stepped adjusting mold instead of a flat plate so that it is possible to fix the flange 52 of the cathode support 50 and the emissive layer 51 in two parallel planes situated at a distance determined by the adjusting mold.

Figure 6:
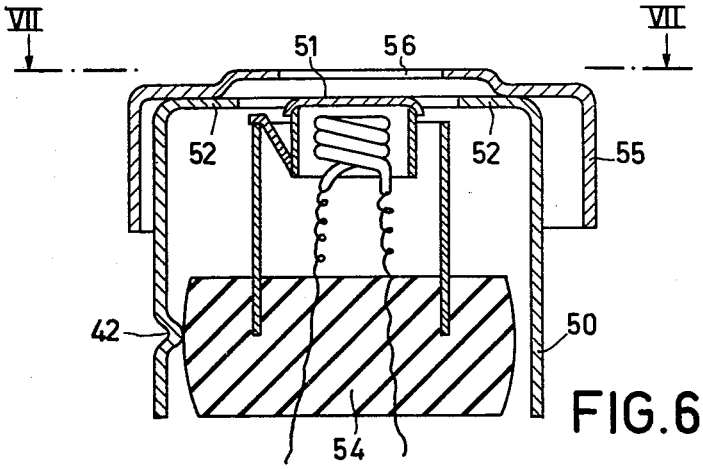
Figure 7:
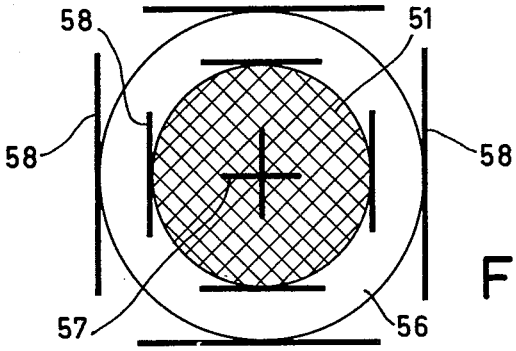

The disc 54 of electrically insulating material is then clamped in the cathode support 50 by means of depressions 42 (see FIGS. 4 and 6). The cathode support 50 with cathode 49 is then placed in the anode 55 (see FIG. 6). By moving the cathode support 50 and the anode 55 radially relative to each other, the center of the emissive layer 51 and the center of the central aperture 56 in the anode 55 can be aligned opposite to each other. The anode 55 and the cathode support 50 are then secured together by means of spot welding. As shown in FIG. 7, the adjustment can be carried out very accurately by means of a microscope having a graticule consisting of straight lines 58 and a central cross 57. (A graticule is a number of lines or wires provided in the focal plane of a microscope). The emissive surface 51, which is shown shaded in FIG. 7 is moved coaxially below the aperture 56 by moving the cathode support 50 relative to the anode 55. The cross 57 now establishes the center of the emissive surface 51 and of the central aperture 56. The center of the aperture in the anode plate (e.g. plate 47 in FIG. 4) is then positioned by means of this cross 57, after which the anode plate is welded to the anode.

Figure 8:
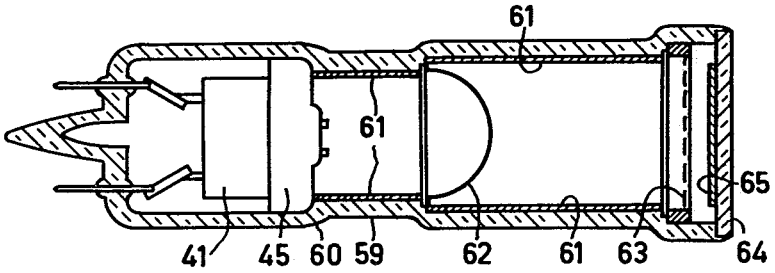
FIG. 8 is a sectional view of a camera tube including an electron gun according to the invention.

FIG. 8 is a partial sectional view of a camera tube embodying an electron gun according to the invention. The tube includes a glass envelope 59 obtained by drawing a glass tube on a mandril. The envelope has a stepped shape. An electron gun as shown in FIG. 4 is provided in one end of the envelope Anode 45 is mounted against a shoulder 60 in the glass of the envelope. Electrodes 61 are provided on the inner wall of the envelope. The tube further comprises a diaphragm 62, a gauze electrode 63 and a window 64 having a photo-conductive layer 65 on its inside. By using an electron gun according to the invention it is possible to cause the axes of the gun, of the envelope and of the generated electron beam to coincide, so that correction coils may be omitted.

What is claimed is:

1. A method of manufacturing an electron gun of the type having an axis and comprising:

a cathode having a substantially planar electron emissive surface;

a cathode support having a cylindrical side and first and second open ends, the first end substantially lying in a single plane;

an electrically insulating material in which the cathode is mounted, said material and cathode being mounted in the cathode support such that the cathode is electrically insulated from the cathode support and the emissive surface is at the first open end of the cathode support; and a substantially planar anode having an aperture therein, said anode being attached to the first end of the cathode support;

said method comprising the steps of:

placing the first end of the cathode support on a first transparent planar surface;

placing the cathode and the electrically insulating material into the cathode support such that the emissive surface of the cathode is at the first open end of the cathode support on a transparent planar surface which is at least parallel to the first transparent planar surface; and fixing the position of the insulating material in the cathode support.

2. A method as claimed in claim 1, characterized in that:

the electrically insulating material has a convex surface facing the side of the cathode support; and the step of fixing comprises forming at least three depressions in the side of the cathode support to press on the convex surface of the insulating material.

3. A method as claimed in claim 2, characterized in that the method further comprises:

placing the first end of the cathode support against the anode;

aligning the centers of the emissive surface and the anode aperture along the gun axis; and fastening the cathode support to the anode.

* * * * *